US010280706B1

(12) United States Patent
Sharp, III

(10) Patent No.: US 10,280,706 B1
(45) Date of Patent: May 7, 2019

(54) HYDRAULIC SETTING TOOL APPARATUS AND METHOD

(71) Applicant: Harvey Sharp, III, Gray, LA (US)

(72) Inventor: Harvey Sharp, III, Gray, LA (US)

( * ) Notice: Subject to any disclaimer, the term of this patent is extended or adjusted under 35 U.S.C. 154(b) by 0 days.

(21) Appl. No.: 16/119,440

(22) Filed: Aug. 31, 2018

(51) Int. Cl.

| | |
|---|---|
| ***E21B 33/14*** | (2006.01) |
| ***E21B 34/10*** | (2006.01) |
| ***E21B 33/129*** | (2006.01) |
| *E21B 34/00* | (2006.01) |

(52) U.S. Cl.
CPC ..... *E21B 33/14* (2013.01); *E21B 33/1293* (2013.01); *E21B 34/10* (2013.01); *E21B 2034/007* (2013.01)

(58) Field of Classification Search
CPC ..... E21B 23/00
See application file for complete search history.

(56) References Cited

U.S. PATENT DOCUMENTS

| | | | | |
|---|---|---|---|---|
| 3,706,342 | A | 12/1972 | Woolley | |
| 4,522,264 | A | 6/1985 | McNeer | |
| 4,828,037 | A * | 5/1989 | Lindsey | E21B 23/04 166/212 |
| 5,826,652 | A | 10/1998 | Tapp | |
| 6,050,334 | A | 4/2000 | McGarian et al. | |
| 6,394,180 | B1 | 5/2002 | Berscheidt et al. | |
| 6,488,082 | B2 | 12/2002 | Echols et al. | |
| 7,225,870 | B2 * | 6/2007 | Pedersen | E21B 23/01 166/117.7 |
| 7,490,669 | B2 | 2/2009 | Walker et al. | |
| 8,662,164 | B2 * | 3/2014 | Watson | E21B 23/04 166/208 |
| 9,085,960 | B2 | 7/2015 | van Petegem et al. | |

* cited by examiner

*Primary Examiner* — William D Hutton, Jr.
*Assistant Examiner* — Avi T Skaist
(74) *Attorney, Agent, or Firm* — Keaty Law Firm LLC

(57) ABSTRACT

A hydraulic setting tool apparatus and method for drilling operations providing one-trip setting of a cement-retainer assembly and pumping of cement without excessive pulling, pushing, or twisting of the workstring, using hydraulic drilling fluid pressure and internal movement in the tool.

20 Claims, 5 Drawing Sheets

HYDRAULIC SETTING TOOL APPARATUS AND METHOD

BACKGROUND

This invention provides a hydraulic setting tool apparatus and method for drilling operations providing one-trip setting of a cement-retainer assembly and pumping of cement without excessive pulling, pushing, or twisting of the workstring, using hydraulic drilling fluid pressure and internal movement in the tool.

Existing methods of setting cement retainers and pumping cement require variously pulling or pushing with a lot of force on the drill string at the wellhead, or twisting and turning the drill string at the wellhead, in order to transfer those forces to a tool on the workstring. Those operations were developed for traditional drill pipe, where the proper machinery and tools are available at the wellhead, and where the drill pipe can properly transfer those forces down the drill string. With coiled tubing, such pulling, pushing, and twisting operations are not readily performed and are not effective because the coiled tubing will not transfer the forces without significant attenuation and without damage to the coiled tubing.

The prior art does not provide for a hydraulic setting tool that performs any required pulling and pushing internally within the tool, while the tool itself remains stationary.

For example, U.S. Pat. No. 5,826,652 for a "Hydraulic Setting Tool," issued on Oct. 27, 1998 to assignee Baker Hughes Incorporated, provides for a packer with a setting piston mounted on the body thereof. The packer is hydraulically set prior to treating or cementing, and has a sliding sleeve valve that is open during run-in. After the packer has set, the setting tool is released from the valve. The valve may then be operated through manipulation of the tubing string. The tubing string can be disengaged and reengaged into the packer body to determine if the valve has clocked by measuring the pressure conditions at the surface.

U.S. Pat. No. 7,490,669 for a "Multi-Zone, Single Trip Well Completion System and Methods of Use," issued on Feb. 17, 2009 to assignee BJ Services Company, provides for a well completion system for completing two or more separate production zones in a well bore during a single downhole trip. The completion system comprises a completion assembly with two or more production zone assemblies and a completion tool assembly. Each production zone assembly may comprise an automatic system locating assembly and at least two inverted seal systems for sealing against the tool assembly. Further discussed is a formation access valve assembly, or frac window, in a production zone assembly and a crossover assembly in a service tool assembly. The tool assembly comprises a crossover assembly having a through wall port allowing fluid communication from an inside surface of the tool assembly to an outside tool assembly surface. In a preferred embodiment, the through wall port is formed on an angle of between about 45 to 150 degrees, and more preferably about 120 degrees to the tool centerline, a downhole orientation. The crossover assembly also comprises an internal sleeve having a seat surface adjacent the port. In a preferred embodiment, the sealing surface is adapted to seal against a ball or other substantially spherical object that engages the seat. This ball/seat sealing arrangement may be used to activate the setting tool and set the production packer, as is conventional. Located below the seat is a circulation port, which allows circulation from the tool assembly annulus to the inside conduit of the service tool assembly during run in.

U.S. Pat. No. 3,706,342 for a "Packer for Wells," issued on Dec. 19, 1972 to inventor Brown J. Woolley, provides for a well tool for controlling fluid flow through a well bore. It has particular application in the form of a packer or bridge plug for insertion down through a restriction such as tubing, collapsed casing or the like in a well, and is adapted for expansion to a size sufficient to engage the casing at a point spaced below the restriction. In operation of the tool, it is initially assembled, and thereafter run into the well casing through tubing. Thereafter, the setting tool is actuated, which causes the upper end of the snubber to contact the lower end of the cylinder of the setting tool. The various shear pins in the system then shear in sequence from top to bottom, such that the various parts of the tool are moved axially together and to the expanded position, with slips engaging the internal surface of casing, and with the fingers containing the packer element. The tool is particularly adapted for expanding the packer element to a diameter of at least twice its initial diameter, with minimal axial force. After setting of the tool, thereafter wire line may be raised, which thereby removes the setting tool and piston, which was previously sheared from the mandrel at a shear point during the setting of the tool.

U.S. Pat. No. 6,488,082 for a "Remotely Operated Multi-Zone Packing System," issued on Dec. 3, 2002 to assignee Halliburton Energy Services Inc., provides for a multi-zone packing system having unique features that allow for remote operation, thereby eliminating the need to raise and lower a work string and crossover tool to various zones of interest during a frac pack, gravel pack, or related completion procedure. The squeeze pack system has a crossover tool or port collocated with each zone of interest and remotely operated closing devices to allow for the setting of each packer and the packing job to be performed with minimal or no movement of the work string. In particular, covered is an apparatus for use in a wellbore, where the apparatus features (a) inner tubing placed within the wellbore; (b) middle tubing attached to the inner tubing, and further containing the lower section of the inner tubing; (c) outer tubing containing and concentric with a portion of the middle tubing; (d) a crossover port for transporting fluid from the inner tubing through the middle tubing; (e) a port on the outer tubing; and (f) a device for controlling the communication of fluid between ones of the inner tubing, the middle tubing, and the outer tubing. The outer tubing may further include a hydraulically set packer, a gravel pack assembly attached to the hydraulically set packer, and a screen attached to the gravel pack assembly. In some embodiments, the packing system provides for the crossover port being controlled by a remotely activated valve, or a circulation valve providing communication between the outer tubing and middle tubing.

U.S. Pat. No. 6,394,180 for a "Frac Plug with Caged Ball," issued on May 28, 2002 to assignee Halliburton Energy Services, Inc., provides for a downhole tool for sealing a wellbore. The downhole tool includes a packer with a ball seat defined therein. A sealing ball is carried with the packer into the well. The movement of the sealing ball away from the ball seat is limited by a ball cage, which is in turn attached to the upper end of the packer. The ball cage has a plurality of ports therethrough, for allowing flow into the ball cage and through the packer at certain flow rates. A spring is disposed in the longitudinal opening of the packer, and engages the sealing ball to prevent the sealing ball from engaging the ball seat until a predetermined flow rate is reached. When the packer is set in the hole, flow through the frac plug below a predetermined flow rate is permitted. Once a predetermined flow rate in the well is reached, a spring force of the spring will be overcome and the sealing ball will engage the ball seat so that no flow through the frac plug is permitted.

U.S. Pat. No. 4,522,264 for an "Apparatus and Method for Treating Wells," issued on Jun. 11, 1985 to assignee Otis Engineering Corporation, provides for an apparatus for packing particulates such as sand, gravel, or the like around a well screen in a well, for sand control. The apparatus has provisions for packing the particulates tightly in place without relying on settling due to gravity, thus requiring minimal distance between the packer and the casing perforations. Methods of performing the packing operations are also disclosed. In particular, the apparatus features (a) well packer means, (b) well screen means connected below the packer means, (c) means for providing lateral flow port means between the packer means and the screen means, and (d) a service seal unit tool means, attached to the packer and attachable to a pipe string, where the service seal unit tool means further features (i) tubular body means telescopically engaged in the packer means, (ii) means on the tubular body means sealing both above and below the lateral port means, (iii) tubular wash pipe means extending through the tubular body means and the packer, and having its upper end opening outwardly into the well annulus above the packer while its lower end opens into the screen means, with the wash pipe having a lateral circulation port in its wall communicating with the interior of the screen means, (iv) means sealing between the screen means and the wash pipe below the lateral circulation port, and (v) means initially closing the lateral circulation port, being movable to port-open position automatically when the pressure exterior of the wash pipe exceeds the pressure interior thereof by a predetermined amount.

U.S. Pat. No. 6,050,334 for a "Single Trip Whipstock Assembly," issued on Apr. 18, 2000 to inventors Bruce McGarian et al., provides for a single trip whipstock assembly that can be run into a well, set, and operated from a window in the wall casing in a single trip. The system includes a milling tool attached to the upper end of a whipstock, to the lower end of which is attached a packer or anchor that can be set by appropriate means prior to detachment of the mill from the whipstock to initiate window formation. The packer may be hydraulic and may be set by means of a setting tool located above the mill and connected to the packer by a hose. The mill incorporates circulation ports that are initially isolated from the central chamber thereof, to permit flow of hydraulic fluid from the setting tool to the hose via the interior of the mill. Once the setting has been effected, the hose is severed, permitting the piston of the setting tool to operate a flow diverter within the mill and open the circulation ports to the interior of the tool for subsequent drilling mud circulation during milling operation. The whipstock includes a relatively steep ramp at the upper end thereof, so that initial breakthrough of the casing is effected predominantly using the side blades of the mill.

Lastly, U.S. Pat. No. 9,085,960 for a "Gravel Pack Bypass Assembly," issued on Jul. 21, 2015 to assignee Weatherford Technology Holdings, LLC, provides for a gravel pack operation that disposes slurry from an inner string into the annulus around a shoe track. A valve on the shoe track can open and close flow through a port, and seats around the port allow an outlet of the tool to seal with the port. When the valve is open, and the outlet sealed with the port, the slurry in the string is pumped into the borehole around the shoe track by flowing the slurry from the outlet into the borehole through the flow port. As this occurs, gravel collects around the shoe track, and fluid returns in the borehole flow back into the shoe track through a screen disposed toward the track's toe. Once inside the shoe track, the fluid returns communicate through a bypass on the shoe track around the sealed outlet and port. At this point, the fluid returns can pass uphole in the gravel pack assembly.

What is needed is a hydraulic setting tool that can perform any required pulling and pushing internally within the tool, while the tool itself remains stationary.

SUMMARY OF THE INVENTION

This invention provides a hydraulic setting tool apparatus and method for drilling operations providing one-trip setting of a cement-retainer assembly and pumping of cement without excessive pulling, pushing, or twisting of the workstring, using hydraulic drilling fluid pressure and internal movement in the tool.

An upper assembly and a cement-retainer assembly are made up on the workstring and lowered to depth. Using pressure of the drilling fluid against a phenolic ball dropped into the workstring and seating within the upper assembly, inner components of the upper assembly are forced upward in relation to non-moving outer components, compressing and setting the cement-retainer assembly. Then a cement-flow bypass channel is created by differential upward movement of inner components, allowing pumping of cement below the cement-retainer assembly.

BRIEF DESCRIPTION OF THE DRAWINGS

Reference will now be made to the drawings, wherein like parts are designated by like numerals, and wherein.

DETAILED DESCRIPTION OF THE INVENTION

Figure 1:
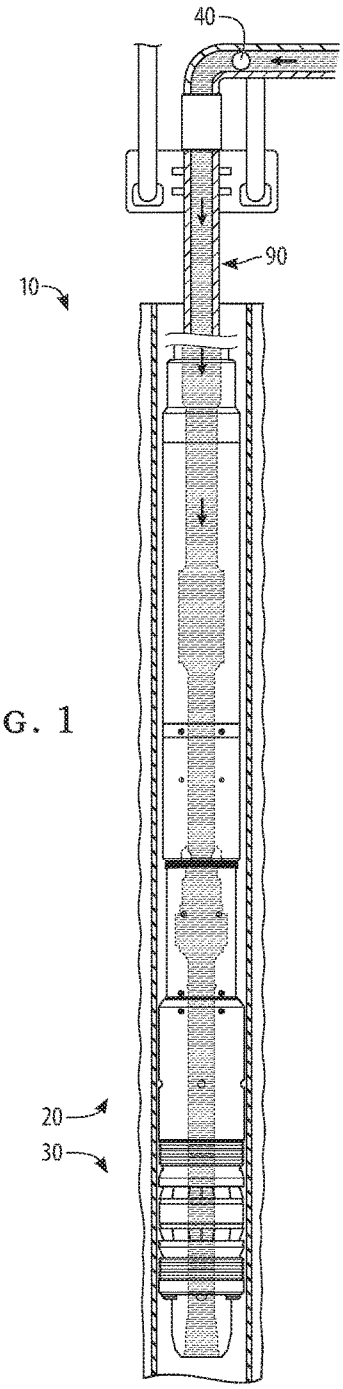
FIG. 1 is a schematic view of the hydraulic setting tool of the invention at an earlier phase of use.
Figure 2:
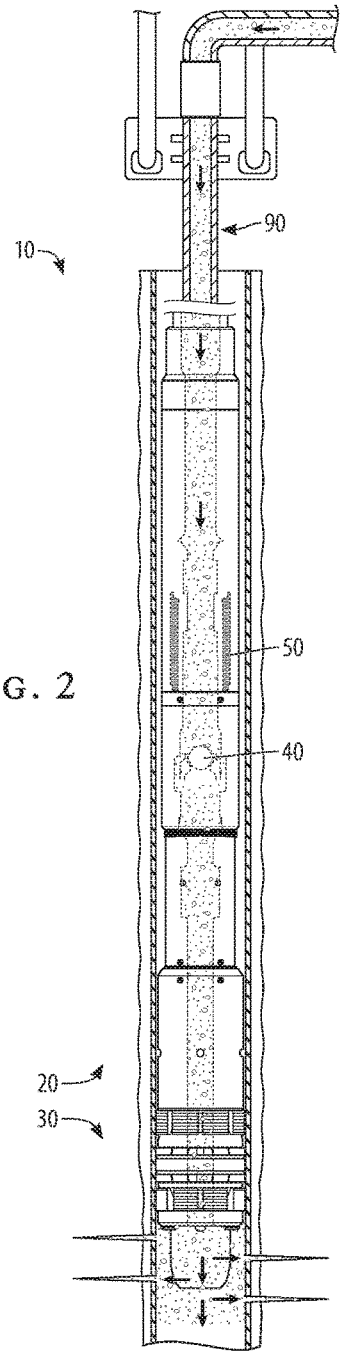
FIG. 2 is a schematic view of the hydraulic setting tool of the invention at a later phase of use.

Referring to FIG. 1 and FIG. 2, the major assemblies and the operation of the hydraulic setting tool 10 apparatus and method of the invention is shown. In FIG. 1, hydraulic drilling fluid is being pumped through the workstring and into the upper assembly 20 and cement-retainer assembly 30 of the hydraulic setting tool. The cement-retainer assembly 30 is not yet set within the casing. A phenolic ball 40 has been dropped into the workstring and will be pumped down into the upper assembly 20, where it will be stopped and will cause a build-up in the differential pressure at the tool. In FIG. 2, the cement-retainer assembly 30 has been set against the casing by compression of the cement-retainer assembly. This compression has been achieved without any pulling, pushing, or twisting of the workstring 90, and the upper assembly 20 as a whole, has not moved up-hole or down-hole. The phenolic ball 40 seated within the upper assembly is indicated. The build-up of hydraulic drilling fluid under pressure inside a hydraulic chamber 50 is also indicated. With the cement-retainer assembly 30 set against the casing, and with a cement-flow path opened around the phenolic ball 40, cement is being pumped through the workstring 90, the upper assembly 20, and the cement-retainer assembly 30 into the casing below the cement-retainer assembly. The operation has been performed in one single trip into the hole, without any pulling, pushing, or twisting of the workstring 90 or the tool on the workstring.

Figure 3:
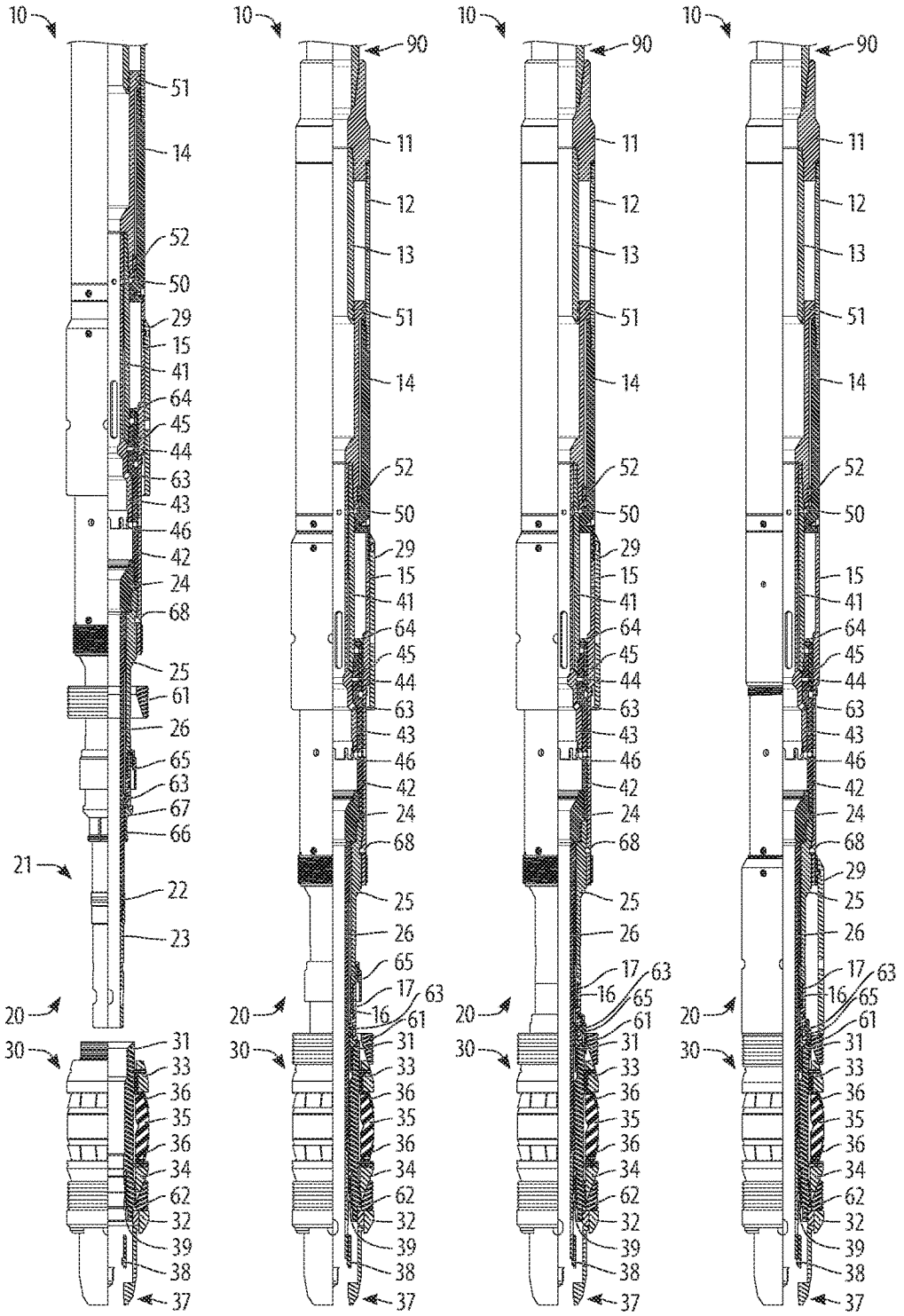
FIG. 3 is a part-sectional view of the hydraulic setting tool of the invention at four phases of assembly.

Referring to FIG. 3, the component parts of the upper assembly 20 and cement-retainer assembly 30 are identified, and the method of making up the hydraulic setting tool 10 on the workstring 90, for use, is illustrated.

The cement-retainer assembly 30 provides a squeeze-packer body 31 of tubular form which has an outer surface allowing slidable mounting of other components. A squeeze-packer lower stop 32 is fixed at the down-hole portion of the squeeze-packer body 31 for the purpose of stopping other components from sliding off, thereby allowing for compressing force to be applied to those components. The following components are placed upon and around the squeeze-packer body 31 such that the components are free to slide up and down the squeeze-packer body 31. A squeeze-packer bridge plug 35 of deformable material is placed around the squeeze-packer body 31 at a medial position. The deformable material can be a hard rubber or similar material that will, when squeezed, deform and bulge outward to make good frictional contact with the casing. Bridge-plug retainers 36, one each up-hole and down-hole of the squeeze-packer bridge plug 35 made of a sheet metal or similar material, even out the compressive pressure placed upon the bridge plug, and ensure that the middle of the bridge plug rather than the edges is allowed to bulge outward. A top tapered ring 33 having a tapered outer surface with the smallest circumference at the up-hole end, and a bottom tapered ring 34 having a tapered outer surface with the smallest circumference at the down-hole end, are placed around the squeeze-packer body 31 up-hole and down-hole of the squeeze-packer bridge plug 35, in contact with the corresponding bridge-plug retainer 36. A top slip 61 having a tapered inner surface with the smallest circumference at the down-hole end, and a bottom slip 62 having a tapered inner surface with the smallest circumference at the up-hole end, are placed around the squeeze-packer body 31 up-hole and down-hole of the top tapered ring 33 and bottom tapered ring 34. The tapered surfaces of the slips 61, 62 and the corresponding tapered rings 33, 34 are facing and are in contact with each other, and under compressive force will slip against each other and will cause the slips 61, 62 to be forced outward. The slips 61, 62 are made to break into segments, allowing outward expansion and being forced and held against the casing. In use, the components of the cement-retainer assembly 30 will be compressed together, resulting in outward expansion of the slips 61, 62 and the squeeze-packer bridge plug 35, and securely setting the cement-retainer assembly against the casing in preparation for the cementing operations.

The cement-retainer assembly 30 also provides a stinger stop 38 to guide and stop in position the stinger 21 of the upper assembly 12 when it is placed within the squeeze-packer body 31, as treated below. One or more valve shoe ports 37 at the down-hole end of the squeeze-packer body 31 allow the flow of fluid material, including cement, out of the squeeze-packer body 31 and into the casing. A sleeve valve 39 shuts the valve shoe ports 37 when no stinger 21 is present inside the squeeze-packer body 31, and opens the valve shoe ports 37 when the stinger 21 is present and mounted.

The upper assembly 20 provides a top sub 11 of standard configuration for mounting upon the workstring 90. On the down-hole end of the top sub 11 are mounted an upper cylinder 12 mounted upon the outer surface of the top sub 11, and an upward compensator 13 mounted upon the inner surface of the top sub 11, such that a void area is defined between the upper cylinder 12 and the upward compensator 13. A lower piston 14 is mounted at the down-hole end of the upper cylinder 12, and a push sleeve 15 is mounted at the down-hole end of the lower piston 14. Therefore, the upper cylinder 12, lower piston 14, and push sleeve 15 form a tubular outer unit that is fixed in place in relation to the top sub 11.

An upper piston 51 is provided inside the lower piston 14 and can slide against the lower piston. The upper piston 51 has a piston seal 52 in contact with the lower piston 14. The upper piston 51 can travel upwards within the void area between the upper cylinder 12 and the upward compensator 13. A hydraulic chamber 50 is defined between the upper piston 51 below the piston seal 52 and the lower piston 14. The hydraulic chamber 50 can expand upwards with increased pressure of drilling fluid, thereby pushing the upper piston 51 upward in relation to the lower piston 14.

An upper ball-seat housing 41 with circulation ports is mounted near the down-hole end of the upper piston 51, and extends below the upper piston 51 such that the circulation ports are below and clear of the upper piston 51. A void area is defined between the upper ball-seat housing 41 and the push sleeve 15. A ball seat 43 of tubular form is provided inside the upper ball-seat housing 41. The ball seat 43 has an elongated upper portion extending along and inside of the upper ball-seat housing 41. This elongated upper portion of the ball seat 43 has circulation ports which, with the ball seat 43 in an initial position relative to the upper ball-seat housing 41, line up with the circulation ports of the upper ball-seat housing 41, providing open hydraulic ports leading to the hydraulic chamber 50.

A lower ball-seat housing 42 is provided mounted to the down-hole end of the upper ball-seat housing 41, to the outside of the lower portion of the ball seat 43. The ball seat 43 is provided with bypass ports to allow a bypass flow of fluid, and in an initial position the lower ball-seat housing 42 blocks these bypass ports. One or more ball-seat locks 44 extend through the lower ball-seat housing 42 and engage a lock slot in the ball seat 43, preventing the sliding of the lower ball-seat housing 42 and the connected upper ball-seat housing 41 in relation to the ball seat 43. A ball-seat lock retainer 45 is mounted on the outside of the lower ball-seat housing 42 such that the ball-seat locks 44 are held in place inside the lock slot of the ball seat 43 when the ball-seat lock retainer 45 is in an initial position, and the ball-seat locks 44 are allowed to recess into a slot in the ball-seat lock retainer 45 when the ball-seat lock retainer 45 is allowed to slide into an unlocking position. The sliding of the ball-seat lock retainer 45 against the lower ball-seat housing 42 is prevented by one or more medium-shear screws 68 fixing the ball-seat lock retainer 45 to the lower ball-seat housing 42. In a preferred embodiment, two medium-shear screws 63 made of brass and rated at 2000 pounds are used at this location.

Optionally, a snap ring 64 can be provided at the up-hole end of the lower ball-seat housing 42.

The ball seat 43 also provides a seat area for the phenolic ball 40, such that when the phenolic ball 40 is in place upon the seat, the flow of drilling fluid is blocked by the phenolic ball 40, the ball seat 43, the upper ball seat housing 41, and lower ball-seat housing 42. The bypass ports of the ball seat 43, located down-hole of the phenolic ball 40, are blocked by the lower ball-seat housing 42 at this point.

A tandem connector sub 24 is mounted to the down-hole end of the lower ball-seat housing 42, which is below the ball seat 43. The push sleeve 15 continues to extend downward, surrounding the tandem connector sub 24. A ball seat latch 46 is mounted to the down-hole end of the ball seat 43, and is adapted to latch to the tandem connector sub 24 at a later step in the use of the hydraulic setting tool 10.

A lower compensator housing 25 is mounted to the down-hole end of the tandem connector sub 24 such that an up-hole portion of the lower compensator housing 25 is slidably mounted within the push sleeve 15. At least one high-shear screw 68 fixes the push sleeve 15 and the lower compensator housing 25 each to the other, preventing sliding. In a preferred embodiment, two high-shear screws 68 made of brass and rated at 6000 pounds are used at this location.

A lower compensator piston 26 is mounted within and extends down-hole from the lower compensator housing 25, such that the lower compensator piston 26 and the lower compensator housing 25 can slide in relation each to the other.

A lock ring 16 is mounted upon the lower compensator piston 26 immediately down-hole of the lower compensator housing 25, held in place by a lock ring retainer 17 thread-mounted upon the down-hole end of the lower compensator housing 25.

A snap latch 66 structure having a locating shoulder 67 is thread-mounted upon the lower compensator piston 26 such that an upper portion of the snap latch 66 structure is interleaved between the lower compensator piston 26 and the lock ring retainer 17. The snap latch 66 structure guides the lower compensator piston 26 into the squeeze-packer body 31 of the cement-retainer assembly 30, and holds it within the squeeze-packer body 31 as a latch mount. In a preferred embodiment, the snap latch 66 is designed to snap in at 2000 pounds and snap out at 8000 pounds. The lock ring retainer 17 and the lower compensator piston 26 are fixed each to the other by one or more medium-shear screws 63. In a preferred embodiment, two medium-shear screws 63 made of brass and rated at 2000 pounds are used at this location.

A stinger 21 structure is formed at the down-hole end of the upper assembly 20, having a stinger shifter sub 23 with ports thread-mounted upon the down-hole end of the lower compensator piston 26, with a molded stinger seal 22 mounted upon the lower compensator piston 26 immediately up-hole of the stinger shifter sub 23.

An extension housing 29 with ventilation ports is provided for thread-mounting upon the down-hole end of the push sleeve 15. In use, the extension housing 29 transfers the force of the push sleeve 15, lower piston 14, upper cylinder 12, and top sub 11, all of which are fixed together and all of which remain stationary during use, to the top slip 61 at the up-hole end of the cement-retainer assembly 30.

A shear ring nut 65 is provided for breakable holding of the down-hole end of the lock ring retainer 17 against the up-hole end of the squeeze-packer body 31 of the cement-retainer assembly 30. Therefore, during making-up prior to use, the upper assembly 20 is attached to the cement-retainer assembly 30 both by the snap latch 66 and by the shear ring nut 65.

A phenolic ball 40 is provided to lodge within the ball seat 43 and block the flow of drilling fluid for a time before disintegrating and allowing resumption of flow. In a preferred embodiment using standard tool, tubing, and bore sizes, the phenolic ball has a diameter of 2.250 inches.

In use, the hydraulic setting tool 10 is made up on the workstring 90 with the upper assembly 20 mounted on the cement-retainer assembly 30 with the stinger 21 portion extending downward into the squeeze-packer body 31. The upper assembly 20 and the cement-retainer assembly 30 are coupled together by the snap latch 66 and the shear ring nut 65 engaging with the squeeze-packer body 31. The stinger shifter sub 23 extends downward to the stinger stop 38, and holds open the sleeve valve 39, thereby opening the valve shoe ports 37. The extension housing 29 is mounted such that the extension housing 29 is fixed in relation to the push sleeve 15 and is in contact with the top slip 61 at the up-hole end of the cement-retainer assembly 30.

Figure 4:
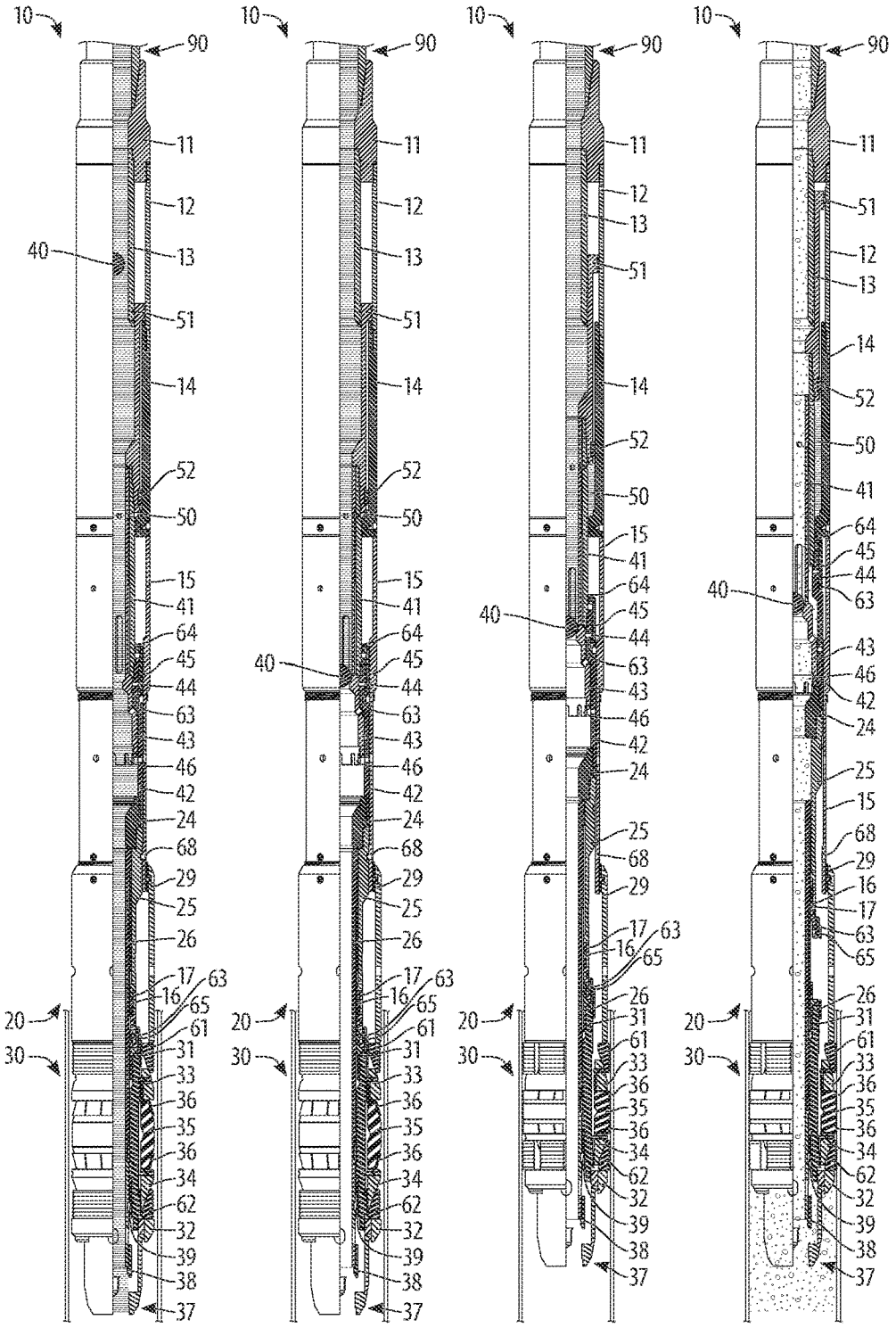
FIG. 4 is a part-sectional view of the hydraulic setting tool of the invention at four phases of use.
Figure 5:
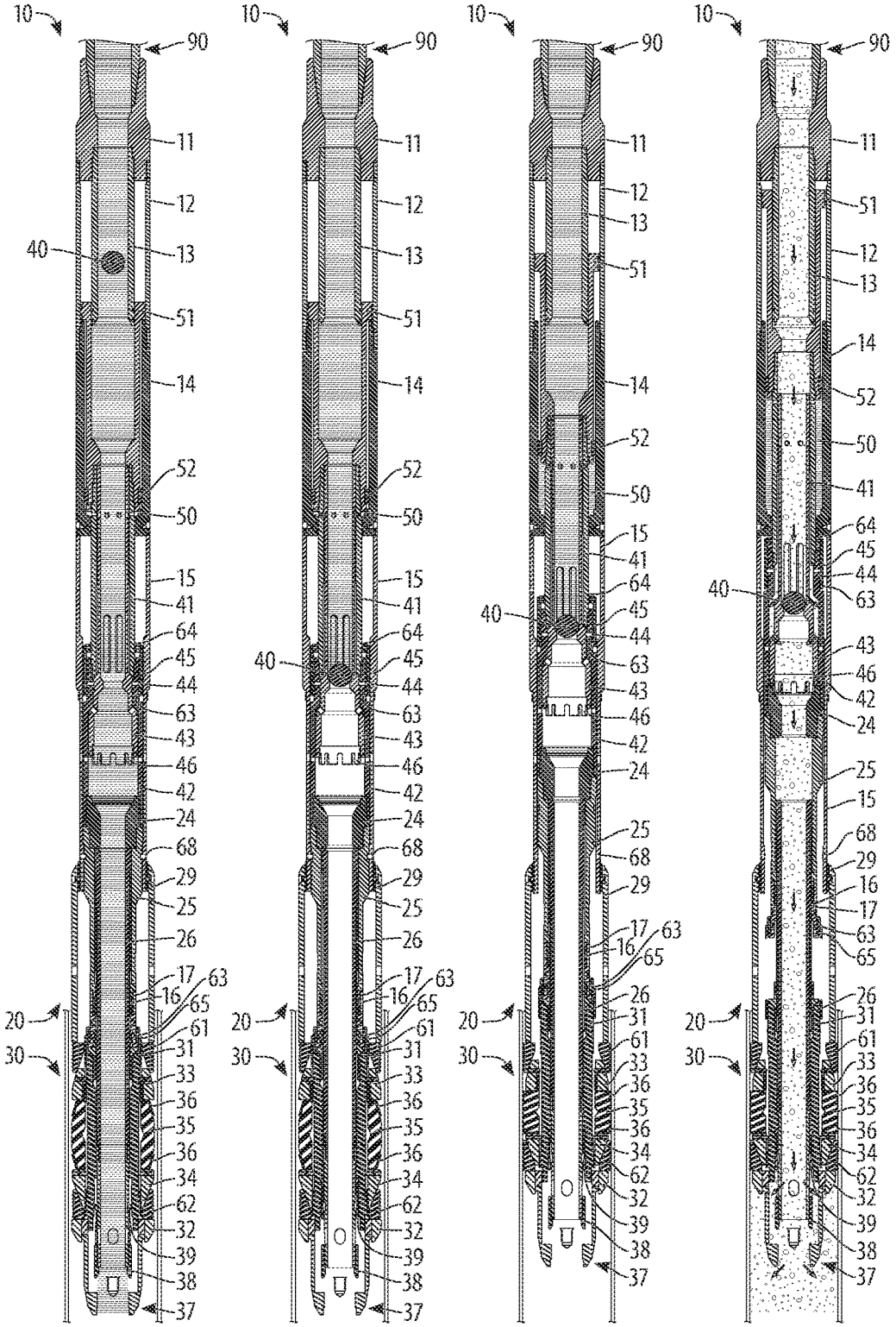
FIG. 5 is a sectional view of the hydraulic setting tool of the invention at four phases of use.

Referring to FIG. 4 and FIG. 5, in use, the hydraulic setting tool 10 made up on the workstring 90 is lowered to several feet below the desired setting depth, and is then picked up slowly to the desired setting depth in order to remove slack from the workstring 90. The phenolic ball 40 is dropped and slowly pumped down until it has seated, resulting in an increase in drilling fluid pressure.

The workstring drilling fluid pressure is slowly brought up to a 1650 psi differential at the tool to begin the setting sequence. Inside the tool, the drilling fluid under pressure enters the hydraulic chamber 50 through the aligned circulation ports in the ball seat 43 and the upper ball-seat housing 41, exerting upward force against the upper piston 51 below the piston seal 52, thereby moving the upper piston 51 upward in relation to the lower piston 14, upper cylinder 12, and top sub 11. The upward movement of the upper piston 51 is accommodated in the void area between the upward compensator 13 and the upper cylinder 12. The lower piston 14, upper cylinder 12, and top sub 11, which are all connected, do not move up-hole nor down-hole. Therefore, the workstring 90 mounted to the top sub 11 is not moved and does not have additional forces placed upon it.

The upward movement of the upper piston 51 exerts an upward force on the connected upper ball-seat housing 41, which in turn exerts an upward force on the connected lower ball-seat housing 42. The ball-seat locks 44 are engaged in the lock slot of the ball seat 43, and therefore the lower ball-seat housing 42 exerts an upward force on the ball seat 43, and also exerts an upward force on the connected tandem connector sub 24, which in turn exerts an upward force on the connected lower compensator housing 25, where such upward force is resisted by the high-shear screws 68 fixing the lower compensator housing 25 to the push sleeve 15.

The pressure is brought up to a 2500 psi differential at the tool, and held for ten minutes, shearing the high-shear screws 68 fixing the lower compensator housing 25 to the push sleeve 15, in turn allowing upward movement of the lower ball-seat housing 42, which in turn exerts an upward force, through the lock ring retainer 17, to both the snap latch 66 connected through the medium-shear screws 63, and the squeeze-packer body 31 connected through the shear ring nut 65, thereby causing an upward movement of the squeeze-packer body 31. The upward movement of the squeeze-packer body 31 causes an upward force on the connected squeeze-packer lower stop 32, which travels in an up-hole direction, pushing the top and bottom slips 61, 62, top and bottom tapered rings 33, 34, bridge-plug retainers 36, and squeeze-packer bridge plug 35 all upwards. The top slip 61 is prevented from moving upwards by the extension housing 29, which is fixed to the push sleeve 15. Therefore, the top and bottom slips 61, 62, top and bottom tapered rings 33, 34, bridge-plug retainers 36, and squeeze-packer bridge plug 35 are all compressed and driven toward the middle of the squeeze-packer bridge plug 35, which deforms with an outward bulge that makes strong frictional contact with the casing. Also, with the top and bottom tapered rings 33, 34 being driven against and behind the top and bottom slips 61, 62, the top and bottom slips 61, 62 expand outward and also make strong frictional contact with the casing. At this point, the cement-retainer assembly 30 has been set within the casing.

The workstring is then picked up 5000 pounds over its tubing weight, and differential pressure at the tool is brought to 3430 psi, causing increased upward force on the upper piston 51, upper ball-seat housing 41, lower ball-seat housing 42, tandem connector sub 24, lower compensator housing 25, and lock ring retainer 17, in turn causing shearing of the medium-shear screws 63 fixing the ball-seat lock retainer 45 to the lower ball-seat housing 42, allowing sliding and the accommodation of the ball-seat locks 44 within the unlocked-position slot of the ball-seat lock retainer 45, thereby releasing the ball seat 43 and allowing further upward travel of the upper piston 51.

Figure 6:
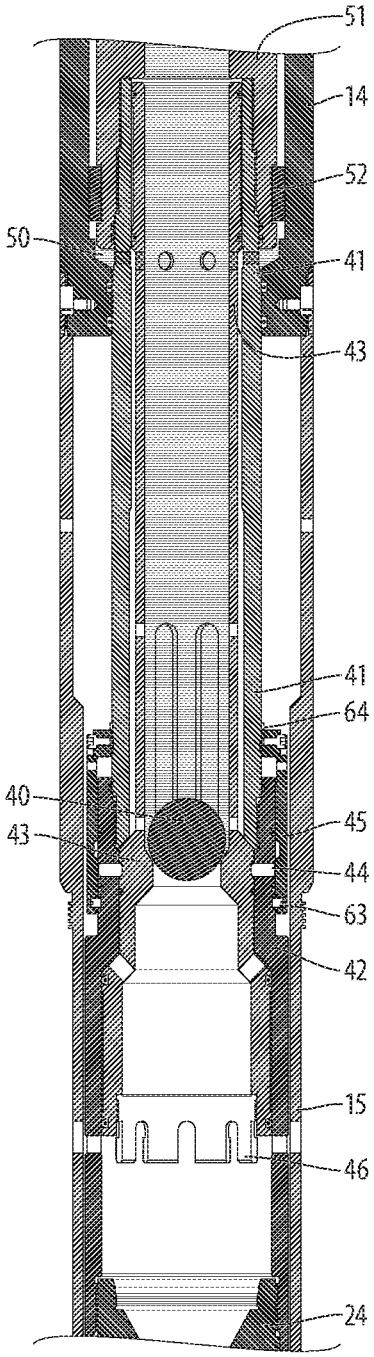
FIG. 6 is a detailed sectional view of the hydraulic setting tool of the invention at an earlier phase of use.
Figure 7:
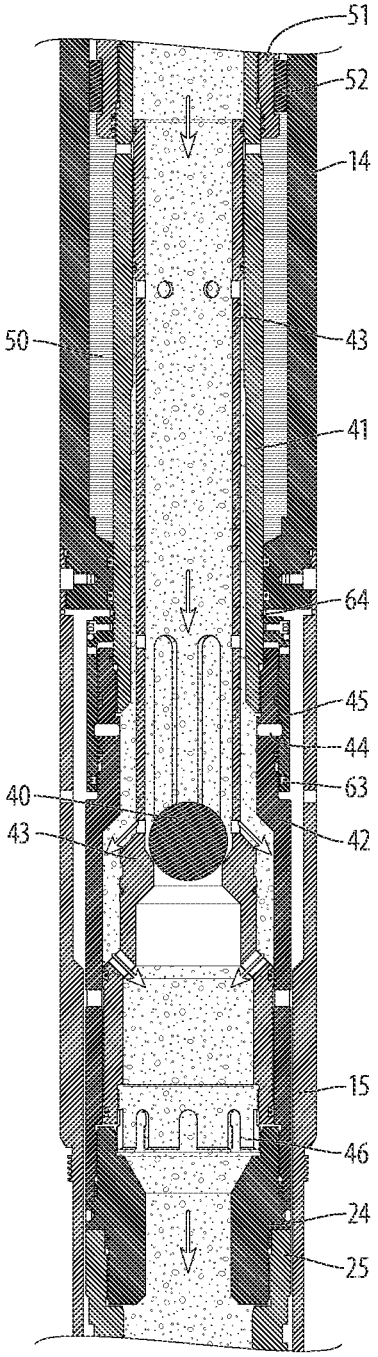
FIG. 7 is a detailed sectional view of the hydraulic setting tool of the invention at a later phase of use.

Referring to FIG. 6 and FIG. 7, where the ball seat 43 was formerly fixed to the lower structures through the ball-seat locks 44 and the lower ball-seat housing 42, the ball seat 43 becomes fixed to the lower structures through the ball seat latch 46 attaching to the tandem connector sub 24. Consequently, the ball seat 43 travels upward, but does not travel upward as much as the upper and lower ball-seat housings 41, 42 do. A gap is opened between the ball seat 43 and the upper and lower ball-seat housings 41, 42, such that the lower ball-seat housing 42 no longer blocks the bypass ports provided in the ball seat 43. The gap and the unblocked bypass ports form a cement-flow path around the phenolic ball 40 in the ball seat 43. The differential upward movement of the ball seat 43 and the upper and lower ball-seat housings 41, 42 cause the formerly aligned circulation ports at the up-hole portions of the ball seat 43 and the upper ball-seat housing 41 to become misaligned, thereby blocking the former path for hydraulic drilling fluid to the hydraulic chamber 50.

The additional upward force also causes shearing of the medium-shear screws 63 fixing the lock ring retainer 17 to the snap latch 66, and causing shearing of the shear ring nut 65 fixing the lock ring retainer 17 to the squeeze-packer body 31, and in turn causing separation of the snap latch 66 and the cement-retainer assembly 30 from the upper assembly 20.

At this point, cement may be pumped through the cement-flow path through the upper assembly 20, through the cement-retainer assembly 30 in its set state, and exiting through the valve shoe ports 37, and into the casing below the cement-retainer assembly 30.

Many other changes and modifications can be made in the system and method of the present invention without departing from the spirit thereof. I therefore pray that my rights to the present invention be limited only by the scope of the appended claims.

I claim:

1. A hydraulic setting tool apparatus for drilling operations using a workstring with up-hole and down-hole orientation, the hydraulic setting tool comprising:

(i) a cement-retainer assembly, comprising:
- (a) a squeeze-packer body of tubular form, having an outer surface allowing slidable mounting of other components;
- (b) a squeeze-packer lower stop fixed at the down-hole portion of said squeeze-packer body;
- (c) a squeeze-packer bridge plug of deformable material arrayed upon said squeeze-packer body at a medial position;
- (d) two bridge-plug retainers, one arrayed up-hole of said squeeze-packer bridge plug and one arrayed down-hole;
- (e) a top tapered ring having a tapered outer surface with the smallest circumference at the up-hole end, arrayed upon said squeeze-packer body up-hole of said squeeze-packer bridge plug and the corresponding said bridge-plug retainer;
- (f) a top slip having a tapered inner surface with the smallest circumference at the down-hole end, arrayed upon said squeeze-packer body up-hole of said top tapered ring, adapted to expand outward upon exertion of force on the tapered inner surface by the corresponding tapered surface of said top tapered ring;
- (g) a bottom tapered ring having a tapered outer surface with the smallest circumference at the down-hole end, arrayed upon said squeeze-packer body down-hole of said squeeze-packer bridge plug and the corresponding said bridge-plug retainer;
- (h) a bottom slip having a tapered inner surface with the smallest circumference at the up-hole end, arrayed upon said squeeze-packer body down-hole of said bottom tapered ring, adapted to expand outward upon exertion of force on the tapered inner surface by the corresponding tapered surface of said bottom tapered ring;
- (i) a stinger stop adapted to guide and stop in position a stinger placed within said squeeze-packer body;
- (j) at least one valve shoe port at the down-hole end of said squeeze-packer body, adapted to allow the flow of fluid material out of said squeeze-packer body and into the casing; and
- (k) a sleeve valve adapted to shut and open said valve shoe ports;

(ii) a phenolic ball adapted to block the flow of drilling fluid for a time before disintegrating and allowing resumption of flow; and (iii) an upper assembly, comprising:
- (a) a top sub of tubular form adapted for mounting upon the workstring;
- (b) an upper cylinder of tubular form mounted upon the outer surface of said top sub;
- (c) an upward compensator of tubular form mounted upon the inner surface of said top sub, defining a void area between said upper cylinder and said upward compensator;
- (d) an upper piston having a piston seal, adapted to travel upwards within the void area between said upper cylinder and said upward compensator;
- (e) a lower piston tubularly encompassing said upper piston such as to permit upward travel of said upper piston;
- (f) a hydraulic chamber defined between said upper piston below said piston seal and said lower piston, adapted to expand upwards with increased pressure of drilling fluid, thereby pushing said upper piston upward in relation to said lower piston;

(g) a push sleeve with ventilation ports, mounted below and upon said lower piston;

(h) an upper ball-seat housing with circulation ports mounted below and upon said upper piston such that the circulation ports are below and clear of said upper piston, defining a void area between said upper ball-seat housing and said push sleeve;

(i) a ball seat of tubular form, with circulation ports and a lock slot, slidably positioned within and extending down-hole from said upper ball seat housing, adapted to stop said phenolic ball and thereby seal against further down-hole flow of drilling fluid;

(j) a lower ball-seat housing of tubular form, with ventilation ports, slidably positioned upon the outer surface of the down-hole extension of said ball seat;

(k) at least one ball-seat lock adapted to mount into the lock slot of said ball seat along said lower ball-seat housing;

(l) a ball-seat lock retainer slidably mounted upon the outer surface of said lower ball-seat housing using at least one medium-shear screw preventing sliding along said lower ball-seat housing, and providing a slot to accommodate said ball seat lock in an unlocked position;

(m) a tandem connector sub within and mounted to the down-hole portion of said lower ball-seat housing, below said ball seat and within said push sleeve;

(n) a ball seat latch mounted to the down-hole end of said ball seat, adapted to latch to said tandem connector sub;

(o) a lower compensator housing mounted to the down-hole end of said tandem connector sub with an up-hole portion slidably mounted within said push sleeve, mounted with at least one high-shear screw preventing sliding along said push sleeve;

(p) a lower compensator piston slidably mounted within and extending down-hole from said lower compensator housing;

(q) a lock ring mounted upon said lower compensator piston immediately down-hole of said lower compensator housing, held in place by a lock ring retainer thread-mounted upon the down-hole end of said lower compensator housing;

(r) a snap latch having a locating shoulder thread-mounted upon said lower compensator piston and fixed to said lock ring retainer by at least one medium-shear screw, adapted to latch-mount to said squeeze-packer body of said cement-retainer assembly, in use;

(s) a stinger shifter sub with ports, thread-mounted upon the down-hole end of said lower compensator piston;

(t) a molded stinger seal mounted upon said lower compensator piston immediately up-hole of said stinger shifter sub;

(u) an extension housing with ventilation ports, adapted for thread-mounting upon the down-hole end of said push sleeve, in use; and (v) a shear ring nut adapted for breakable holding of the down-hole end of said lock ring retainer against the up-hole end of said squeeze-packer body of said cement-retainer assembly;

where, in use, said upper assembly is mounted upon said cement-retainer assembly, with said stinger shifter sub, said molded stinger seal, and the lower portion of said lower compensator piston being contained within said cement-retainer assembly, by coupling of said snap latch with said squeeze-packer body, and by coupling, using said shear ring nut, said lock ring retainer and said squeeze-packer body;

where, in use, said stinger shifter sub, when mounted at said stinger stop, holds open said sleeve valve at said valve shoe ports;

where, in use, said hydraulic setting tool is made up on a workstring and lowered to several feet below the desired setting depth, said hydraulic setting tool is picked up slowly to desired setting depth to remove slack from workstring, said phenolic ball is dropped and slowly pumped down until it has seated, resulting in an increase in drilling fluid pressure;

where, in use, workstring drilling fluid pressure is slowly brought up to a 1650 psi differential at the tool to begin the setting sequence, drilling fluid under pressure enters said hydraulic chamber through the aligned circulation ports in said ball seat and said upper ball-seat housing, exerting upward force against said upper piston below said piston seal, thereby moving said upper piston upward in relation to said lower piston, upper cylinder, and top sub, where upward movement of said upper piston is accommodated in the void area between said upward compensator and said upper cylinder, such that said top sub and the connected workstring are not moved;

where, in use, upward movement of said upper piston exerts an upward force on connected said upper ball-seat housing, which in turn exerts an upward force on connected said lower ball-seat housing, which through said ball-seat lock engaged in said ball seat, exerts an upward force on said ball seat, and exerts an upward force on connected said tandem connector sub, which in turn exerts an upward force on connected said lower compensator housing, where such upward force is resisted by said high-shear screws fixing said lower compensator housing to said push sleeve, which is held in a fixed relationship to said upper cylinder and top sub, and is held in a fixed relationship to said extension housing, which in turn prevents the upward movement of said top slip of said cement-retainer assembly;

where, in use, pressure is brought up to a 2500 psi differential at the tool, and held for ten minutes, shearing said high-shear screws, in turn allowing upward movement of said lower ball-seat housing, which in turn exerts an upward force, through said lock ring retainer, to both said snap latch connected through said medium-shear screws, and said squeeze-packer body connected through said shear ring nut, thereby causing an upward movement of said squeeze-packer body and said snap latch, where upward movement of said squeeze-packer body causes an upward force on connected said squeeze-packer lower stop, where upward movement of said squeeze-packer lower stop against the fixed position of said extension housing causes compression of said top slip, top tapered ring, squeeze-packer bridge plug, bottom tapered ring, and bottom slip each against the others, causing outward bulging of said squeeze-packer bridge plug and slippage of the tapered surfaces of said top and bottom slips against said top and bottom tapered rings, in turn causing outward expansion of said top and bottom slips, effecting a setting of said cement-retainer assembly within the casing;

where, in use, the workstring is picked up 5000 pounds over its tubing weight, and differential pressure at the tool is brought to 3430 psi, causing increased upward force on said upper piston, upper ball-seat housing, lower ball-seat housing, tandem connector sub, lower compensator housing, and lock ring retainer, in turn causing shearing of said medium-shear screws fixing said ball-seat lock retainer to said lower ball-seat housing, allowing sliding and the accommodation of said ball-seat locks within the unlocked-position slot of said ball-seat lock retainer, thereby releasing said ball seat and allowing further upward travel of said upper piston, opening a cement-flow path around said phenolic ball in said ball seat, also causing shearing of said medium-shear screws fixing said lock ring retainer to said snap latch, and causing shearing of said shear ring nut fixing said lock ring retainer to said squeeze-packer body, and in turn causing separation of said snap latch and said cement-retainer assembly from said upper assembly;

where, in use, said ball seat latch at the down-hole end of said ball seat latches to said tandem connector sub, further allowing and maintaining the cement-flow path;

where, in use, the upward sliding of said upper ball-seat housing against the upper portion of said ball seat causes a misalignment of the circulation ports in each, closing the hydraulic connection to said hydraulic chamber; and where, in use, cement may be pumped through the cement-flow path through said upper assembly, through said cement-retainer assembly in its set state, exiting through said valve shoe ports, and into the casing below said cement-retainer assembly.

2. The hydraulic setting tool apparatus of claim 1, further comprising providing a snap ring at the up-hole end of said lower ball-seat housing.

3. The hydraulic setting tool apparatus of claim 1, where said phenolic ball has a diameter of 2.25 inches.

4. The hydraulic setting tool apparatus of claim 1, where the overall outside diameter of said upper assembly is 7.5 inches.

5. The hydraulic setting tool apparatus of claim 1, where the overall outside diameter of said cement-retainer assembly before setting is 7.5 inches.

6. The hydraulic setting tool apparatus of claim 1, further comprising being adapted for coiled-tubing drilling operations.

7. The hydraulic setting tool apparatus of claim 1, further comprising said high-shear screw made of brass and calibrated for 6000 pounds.

8. The hydraulic setting tool apparatus of claim 1, further comprising said medium-shear screw made of brass and calibrated for 2000 pounds.

9. The hydraulic setting tool apparatus of claim 1, further comprising said shear ring nut made of brass.

10. The hydraulic setting tool apparatus of claim 1, further comprising said snap latch adapted to snap in at 2000 pounds and snap out at 5000 pounds.

11. A hydraulic setting tool method for drilling operations using a workstring with up-hole and down-hole orientation, the hydraulic setting tool method comprising:

(i) providing a hydraulic setting tool apparatus, comprising:

(a) a cement-retainer assembly, comprising:

(1) a squeeze-packer body of tubular form, having an outer surface allowing slidable mounting of other components;

(2) a squeeze-packer lower stop fixed at the down-hole portion of said squeeze-packer body;

(3) a squeeze-packer bridge plug of deformable material arrayed upon said squeeze-packer body at a medial position;

(4) two bridge-plug retainers, one arrayed up-hole of said squeeze-packer bridge plug and one arrayed down-hole;

(5) a top tapered ring having a tapered outer surface with the smallest circumference at the up-hole end, arrayed upon said squeeze-packer body up-hole of said squeeze-packer bridge plug and the corresponding said bridge-plug retainer;

(6) a top slip having a tapered inner surface with the smallest circumference at the down-hole end, arrayed upon said squeeze-packer body up-hole of said top tapered ring, adapted to expand outward upon exertion of force on the tapered inner surface by the corresponding tapered surface of said top tapered ring;

(7) a bottom tapered ring having a tapered outer surface with the smallest circumference at the down-hole end, arrayed upon said squeeze-packer body down-hole of said squeeze-packer bridge plug and the corresponding said bridge-plug retainer;

(8) a bottom slip having a tapered inner surface with the smallest circumference at the up-hole end, arrayed upon said squeeze-packer body down-hole of said bottom tapered ring, adapted to expand outward upon exertion of force on the tapered inner surface by the corresponding tapered surface of said bottom tapered ring;

(9) a stinger stop adapted to guide and stop in position a stinger placed within said squeeze-packer body;

(10) at least one valve shoe port at the down-hole end of said squeeze-packer body, adapted to allow the flow of fluid material out of said squeeze-packer body and into the casing; and

(11) a sleeve valve adapted to shut and open said valve shoe ports;

(b) a phenolic ball adapted to block the flow of drilling fluid for a time before disintegrating and allowing resumption of flow; and (c) an upper assembly, comprising:

(1) a top sub of tubular form adapted for mounting upon the workstring;

(2) an upper cylinder of tubular form mounted upon the outer surface of said top sub;

(3) an upward compensator of tubular form mounted upon the inner surface of said top sub, defining a void area between said upper cylinder and said upward compensator;

(4) an upper piston having a piston seal, adapted to travel upwards within the void area between said upper cylinder and said upward compensator;

(5) a lower piston tubularly encompassing said upper piston such as to permit upward travel of said upper piston;

(6) a hydraulic chamber defined between said upper piston below said piston seal and said lower piston, adapted to expand upwards with increased pressure of drilling fluid, thereby pushing said upper piston upward in relation to said lower piston;

(7) a push sleeve with ventilation ports, mounted below and upon said lower piston;

(8) an upper ball-seat housing with circulation ports mounted below and upon said upper piston such that the circulation ports are below and clear of said upper piston, defining a void area between said upper ball-seat housing and said push sleeve;

(9) a ball seat of tubular form, with circulation ports and a lock slot, slidably positioned within and extending down-hole from said upper ball seat housing, adapted to stop said phenolic ball and thereby seal against further down-hole flow of drilling fluid;

(10) a lower ball-seat housing of tubular form, with ventilation ports, slidably positioned upon the outer surface of the down-hole extension of said ball seat;

(11) at least one ball-seat lock adapted to mount into the lock slot of said ball seat along said lower ball-seat housing;

(12) a ball-seat lock retainer slidably mounted upon the outer surface of said lower ball-seat housing using at least one medium-shear screw preventing sliding along said lower ball-seat housing, and providing a slot to accommodate said ball seat lock in an unlocked position;

(13) a tandem connector sub within and mounted to the down-hole portion of said lower ball-seat housing, below said ball seat and within said push sleeve;

(14) a ball seat latch mounted to the down-hole end of said ball seat, adapted to latch to said tandem connector sub;

(15) a lower compensator housing mounted to the down-hole end of said tandem connector sub with an up-hole portion slidably mounted within said push sleeve, mounted with at least one high-shear screw preventing sliding along said push sleeve;

(16) a lower compensator piston slidably mounted within and extending down-hole from said lower compensator housing;

(17) a lock ring mounted upon said lower compensator piston immediately down-hole of said lower compensator housing, held in place by a lock ring retainer thread-mounted upon the down-hole end of said lower compensator housing;

(18) a snap latch having a locating shoulder thread-mounted upon said lower compensator piston and fixed to said lock ring retainer by at least one medium-shear screw, adapted to latch-mount to said squeeze-packer body of said cement-retainer assembly, in use;

(19) a stinger shifter sub with ports, thread-mounted upon the down-hole end of said lower compensator piston;

(20) a molded stinger seal mounted upon said lower compensator piston immediately up-hole of said stinger shifter sub;

(21) an extension housing with ventilation ports, adapted for thread-mounting upon the down-hole end of said push sleeve, in use; and

(22) a shear ring nut adapted for breakable holding of the down-hole end of said lock ring retainer against the up-hole end of said squeeze-packer body of said cement-retainer assembly;

(ii) mounting said upper assembly upon said cement-retainer assembly, with said stinger shifter sub, said molded stinger seal, and the lower portion of said lower compensator piston being contained within said cement-retainer assembly, by coupling of said snap latch with said squeeze-packer body, and by coupling, using said shear ring nut, said lock ring retainer and said squeeze-packer body, where, in use, said stinger shifter sub, when mounted at said stinger stop, holds open said sleeve valve at said valve shoe ports;

(iii) making up said hydraulic setting tool on a workstring;

(iv) lowering said hydraulic setting tool to several feet below the desired setting depth;

(v) picking up said hydraulic setting tool slowly to desired setting depth to remove slack from workstring;

(vi) dropping said phenolic ball and slowly pumping down until it has seated, resulting in an increase in drilling fluid pressure;

(vii) bringing workstring drilling fluid pressure slowly up to a 1650 psi differential at the tool to begin the setting sequence, where drilling fluid under pressure enters said hydraulic chamber through the aligned circulation ports in said ball seat and said upper ball-seat housing, exerting upward force against said upper piston below said piston seal, thereby moving said upper piston upward in relation to said lower piston, upper cylinder, and top sub, where upward movement of said upper piston is accommodated in the void area between said upward compensator and said upper cylinder, such that said top sub and the connected workstring are not moved;

where, in use, upward movement of said upper piston exerts an upward force on connected said upper ball-seat housing, which in turn exerts an upward force on connected said lower ball-seat housing, which through said ball-seat lock engaged in said ball seat, exerts an upward force on said ball seat, and exerts an upward force on connected said tandem connector sub, which in turn exerts an upward force on connected said lower compensator housing, where such upward force is resisted by said high-shear screws fixing said lower compensator housing to said push sleeve, which is held in a fixed relationship to said upper cylinder and top sub, and is held in a fixed relationship to said extension housing, which in turn prevents the upward movement of said top slip of said cement-retainer assembly;

(viii) bringing pressure up to a 2500 psi differential at the tool, and holding for ten minutes, shearing said high-shear screws, in turn allowing upward movement of said lower ball-seat housing, which in turn exerts an upward force, through said lock ring retainer, to both said snap latch connected through said medium-shear screws, and said squeeze-packer body connected through said shear ring nut, thereby causing an upward movement of said squeeze-packer body and said snap latch, where upward movement of said squeeze-packer body causes an upward force on connected said squeeze-packer lower stop, where upward movement of said squeeze-packer lower stop against the fixed position of said extension housing causes compression of said top slip, top tapered ring, squeeze-packer bridge plug, bottom tapered ring, and bottom slip each against the others, causing outward bulging of said squeeze-packer bridge plug and slippage of the tapered surfaces of said top and bottom slips against said top and bottom tapered rings, in turn causing outward expansion of said top and bottom slips, effecting a setting of said cement-retainer assembly within the casing;

(ix) picking up workstring 5000 pounds over its tubing weight, and bringing differential pressure at the tool to 3430 psi, causing increased upward force on said upper piston, upper ball-seat housing, lower ball-seat housing, tandem connector sub, lower compensator housing, and lock ring retainer, in turn causing shearing of said medium-shear screws fixing said ball-seat lock retainer to said lower ball-seat housing, allowing sliding and the accommodation of said ball-seat locks within the unlocked-position slot of said ball-seat lock retainer, thereby releasing said ball seat and allowing further upward travel of said upper piston, opening a cement-flow path around said phenolic ball in said ball seat, also causing shearing of said medium-shear screws fixing said lock ring retainer to said snap latch, and causing shearing of said shear ring nut fixing said lock ring retainer to said squeeze-packer body, and in turn causing separation of said snap latch and said cement-retainer assembly from said upper assembly;

where, in use, said ball seat latch at the down-hole end of said ball seat latches to said tandem connector sub, further allowing and maintaining the cement-flow path;

where, in use, the upward sliding of said upper ball-seat housing against the upper portion of said ball seat causes a misalignment of the circulation ports in each, closing the hydraulic connection to said hydraulic chamber; and (x) pumping cement through the cement-flow path through said upper assembly, through said cement-retainer assembly in its set state, exiting through said valve shoe ports, and into the casing below said cement-retainer assembly.

12. The hydraulic setting tool method of claim 11, further comprising providing a snap ring at the up-hole end of said lower ball-seat housing.

13. The hydraulic setting tool method of claim 11, where said phenolic ball has a diameter of 2.25 inches.

14. The hydraulic setting tool method of claim 11, where the overall outside diameter of said upper assembly is 7.5 inches.

15. The hydraulic setting tool method of claim 11, where the overall outside diameter of said cement-retainer assembly before setting is 7.5 inches.

16. The hydraulic setting tool method of claim 11, further comprising being adapted for coiled-tubing drilling operations.

17. The hydraulic setting tool method of claim 11, further comprising said high-shear screw made of brass and calibrated for 6000 pounds.

18. The hydraulic setting tool method of claim 11, further comprising said medium-shear screw made of brass and calibrated for 2000 pounds.

19. The hydraulic setting tool method of claim 11, further comprising said shear ring nut made of brass.

20. The hydraulic setting tool method of claim 11, further comprising said snap latch adapted to snap in at 2000 pounds and snap out at 5000 pounds.

* * * * *